US012760523B2

(12) United States Patent
Hoe

(10) Patent No.: US 12,760,523 B2
(45) Date of Patent: Oct. 13, 2026

(54) DOWNSPOUT TO CURB DRAINAGE SYSTEM

(71) Applicant: J.R. Hoe, Inc., Middlesboro, KY (US)

(72) Inventor: Benjamin C. Hoe, Middlesboro, KY (US)

(73) Assignee: J.R. Hoe, Inc., Middlesboro, KY (US)

( * ) Notice: Subject to any disclaimer, the term of this patent is extended or adjusted under 35 U.S.C. 154(b) by 162 days.

(21) Appl. No.: 18/807,450

(22) Filed: Aug. 16, 2024

(65) Prior Publication Data

US 2025/0347118 A1 Nov. 13, 2025

Related U.S. Application Data

(60) Provisional application No. 63/644,547, filed on May 9, 2024.

(51) Int. Cl.
*E04D 13/08* (2006.01)

(52) U.S. Cl.
CPC ..... *E04D 13/08* (2013.01); *E04D 2013/0813* (2013.01)

(58) Field of Classification Search
CPC ..... E04D 13/08; E04D 2013/0813
See application file for complete search history.

(56) References Cited

U.S. PATENT DOCUMENTS 5,340,234 A * 8/1994 Rossi ..... E01C 11/227 405/48
8,656,947 B1 * 2/2014 Barton ..... E04D 13/08 210/170.03
2008/0019776 A1 * 1/2008 Fithian ..... E03F 3/046 405/118
2009/0285632 A1 * 11/2009 Maggiacomo ..... E03F 1/002 405/43
2013/0233398 A1 * 9/2013 Clark ..... E04D 13/076 137/216
2013/0328252 A1 * 12/2013 Burns ..... F27D 17/304 266/157
2015/0308092 A1 * 10/2015 Chromey ..... E03F 3/046 137/363
2016/0319531 A1 * 11/2016 Files, Jr. ..... E03F 3/046
2018/0209132 A1 * 7/2018 Dian ..... E03F 5/0401
2022/0145637 A1 * 5/2022 Gomez ..... E04D 13/08
2022/0298797 A1 * 9/2022 Daley ..... E02D 31/06

* cited by examiner

*Primary Examiner* — Patrick C Williams
(74) *Attorney, Agent, or Firm* — Patrick M. Torre; Stites & Harbison PLLC

(57) ABSTRACT

A downspout-to-curb drain assembly includes a downspout boot defining an interior channel terminating in a downspout boot outlet, a trench drain assembly in fluid communication at a first end thereof with the downspout boot interior channel and outlet, and a curb opening defining an interior channel in fluid communication with the trench drain assembly at a second end thereof. Advantageously, the downspout boot outlet, trench drain assembly, and curb opening transport water runoff below grade.

23 Claims, 19 Drawing Sheets

DOWNSPOUT TO CURB DRAINAGE SYSTEM

RELATED APPLICATIONS

This application claims priority to U.S. provisional patent application Ser. No. 63/644,547 filed on May 9, 2024, the entirety of the disclosure of which is incorporated herein by reference.

TECHNICAL FIELD

This disclosure relates to systems for collecting and diverting runoff water from a structure gutter system, and for passing the runoff water to a street surface. In particular, the disclosure relates to a downspout-to-curb drain system for collecting and passing runoff water to a curb opening or other feature below grade.

BACKGROUND

Conventionally a gutter system for a structure such as a home or office building includes substantially horizontal gutters emptying into a substantially vertical downspout which can be cylindrical, square, or rectangular in cross-section, and from there to a downspout boot or adapter. Advantageously, the downspout boot serves a protective function as well, protecting exposed ends of the downspout from damage.

A trench drain is another known means of collecting and diverting rainwater and runoff water. As the name implies, the trench drain is essentially a trench positioned to collect rainwater/runoff water, and transport it elsewhere. Typically the trench drain is provided with a grate to block debris such as leaves, trash, roof shingle detritus, etc. from collecting in and potentially clogging the trench drain.

Conventionally downspouts and downspout boots are positioned to terminate above grade, i.e., above the surface of the ground, sidewalk, etc. near which the downspout or downspout boot empties. This leads to a less efficient passage of water from the downspout boot from the sidewalk to the road surface and from there to an adjacent storm sewer system or other diversion system, and may additionally lead to structural issues due to retention of water near the structure foundation which can cause foundation damage. The presently-disclosed subject matter addresses the above-identified issues, as will become evident to those of ordinary skill in the art after a study of information provided in this document.

SUMMARY

In one aspect of the disclosure, a downspout-to-curb drain assembly is described comprising a downspout boot defining an interior channel terminating in a downspout boot outlet, a trench drain assembly in fluid communication at a first end thereof with the downspout boot interior channel and outlet, and a curb opening defining an interior channel in fluid communication with the trench drain assembly at a second end thereof. The elongated body may further include at least one exterior anchor configured to anchor the elongated body in a substrate. The downspout boot outlet, trench drain assembly, and curb opening advantageously transport water runoff below grade.

The trench drain assembly comprises a grate including at least one grate locking assembly and an elongated body comprising at least two interior supports for the grate. The grate may include at least one through-bore and at least one through-bore-adjacent lock bar stop disposed on a bottom surface of the grate. The at least one grate locking assembly comprises a bolt passed through the through-bore and a lock bar carried at an end of the bolt. The bolt is dimensioned to carry the lock bar at a spaced distance below the bottom surface of the grate whereby turning the bolt causes the lock bar to engage the stop. The lock bar is dimensioned such that an attempt to remove the grate will cause the lock bar to contact one of a grate stop disposed on an interior of the elongated body or a bottom surface of the at least two interior supports.

In one possible embodiment, the elongated body is a trench pan defining a channel having a substantially rectangular or square cross-sectional dimension.

In one possible alternative embodiment, the elongated body is a frame defined by adjacent walls, wherein each adjacent wall is defined by a pair of upright portions and a connecting portion. The connecting portions may define the at least two interior supports for the grate. A grate stop may be provided on a one of the pair of upright portions.

These and other objects of the present invention will become readily apparent while reviewing the preferred embodiments and examples of the present invention disclosed herein in the description of the invention below and the accompanying drawings. All publications, patents, and patent applications mentioned in this specification, if any, are herein incorporated by reference to the same extent as if each individual publication, patent, or patent application was specifically and individually indicated to be incorporated by reference.

BRIEF DESCRIPTION OF THE DRAWINGS

The novel features of the disclosed downspout-to-curb drain system are set forth with particularity in the appended claims. A better understanding of the features and advantages of the present invention will be obtained by reference to the following detailed description that sets forth illustrative embodiments, in which the principles of the invention are used, and the accompanying drawings of which:

DETAILED DESCRIPTION

Figure 1:
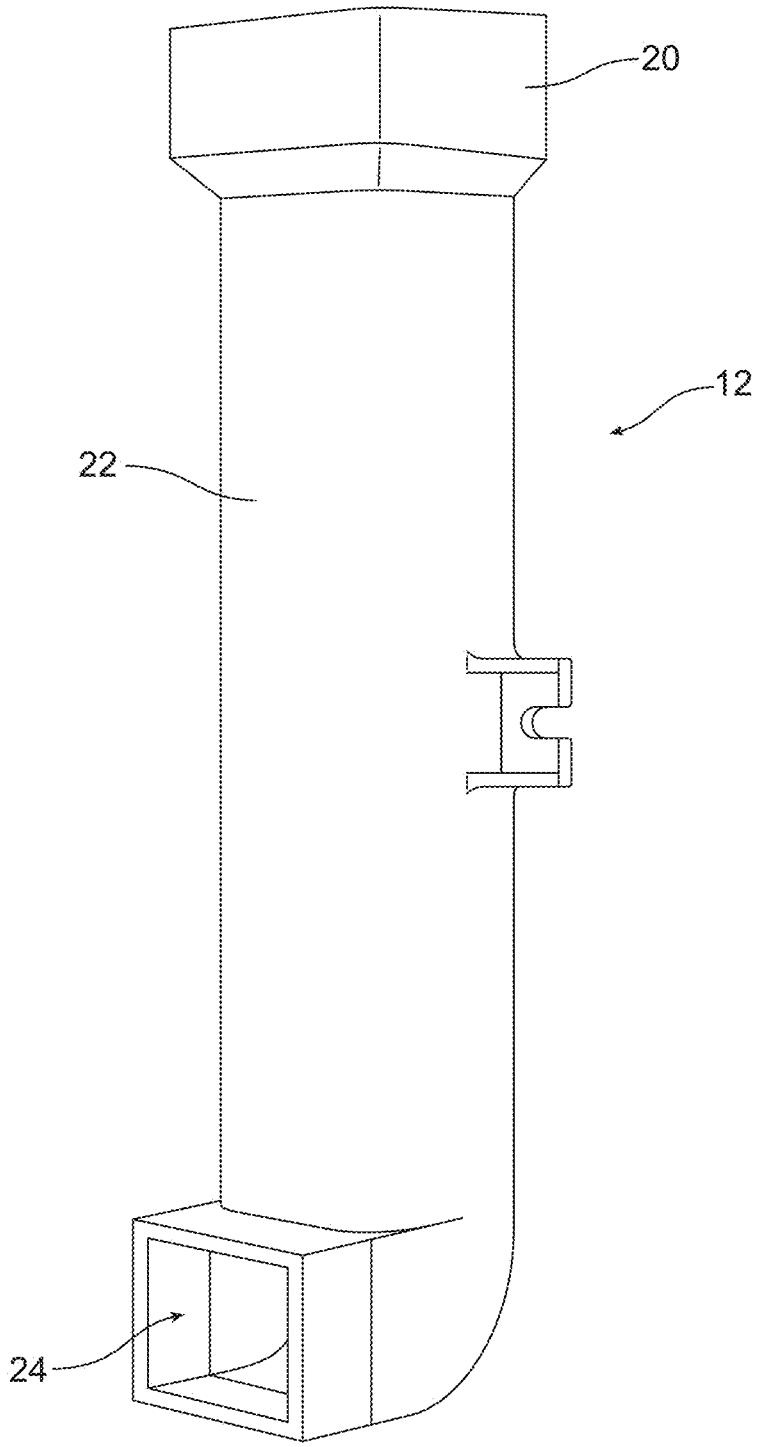
FIG. 1 shows a downspout boot for use in the disclosed system.

The details of one or more embodiments of the presently-disclosed subject matter are set forth in this document. Modifications to embodiments described in this document, and other embodiments, will be evident to those of ordinary skill in the art after a study of the information provided in this document. The information provided in this document, and particularly the specific details of the described exemplary embodiments, is provided primarily for clearness of understanding and no unnecessary limitations are to be understood therefrom. In case of conflict, the specification of this document, including definitions, will control.

It will be appreciated that for simplicity and clarity of illustration, where appropriate, reference numerals are repeated among the various figures to indicate corresponding, identical, or analogous features. Numerous specific details are set forth in order to provide a thorough understanding of the embodiments described herein. However, those of ordinary skill in the art will understand that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

It will be understood also that various details of the presently disclosed subject matter can be changed without departing from the scope of the subject matter disclosed herein. Furthermore, the description is for the purpose of illustration only, and not for the purpose of limitation.

While the terms used herein are believed to be well understood by those of ordinary skill in the art, certain definitions are set forth to facilitate explanation of the presently-disclosed subject matter.

Unless defined otherwise, all technical and scientific terms used herein have the same meaning as commonly understood by one of ordinary skill in the art to which the disclosure belongs. Any methods and materials similar to or equivalent to those described herein can be used in the practice or testing of the present disclosure, including the methods and materials described below.

Following long-standing patent law convention, the terms "a," "an," and "the" refer to "one or more" when used in this application, including the claims.

The terms "comprising," "including," and "having" are intended to be inclusive and mean that there may be additional elements other than the listed elements.

Unless otherwise indicated, all numbers expressing quantities of ingredients, properties such as reaction conditions, and so forth used in the specification and claims are to be understood as being modified in all instances by the term "about." Accordingly, unless indicated to the contrary, the numerical parameters set forth in this specification and claims are approximations that can vary depending upon the desired properties sought to be obtained by the presently-disclosed subject matter.

The term "about," when referring to a value or to an amount of mass, weight, time, volume, concentration, percentage, or the like is meant to encompass variations of in some embodiments ±50%, in some embodiments ±40%, in some embodiments ±30%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed method.

Ranges can be expressed as from "about" one particular value, and/or to "about" another particular value. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

All combinations of method or process steps as used herein can be performed in any order, unless otherwise specified or clearly implied to the contrary by the context in which the referenced combination is made.

Embodiments of the present invention will be further described in detail below with reference to the accompanying drawings. It will be appreciated that a variety of materials and fabrication methods are contemplated for fabrication of the described downspout-to-curb drain system. In embodiments, the components may be fabricated by casting, welding, and others. Any suitable metal or polymer is contemplated, including in particular embodiments cast iron, steel, alloys, or combinations.

Figure 2:
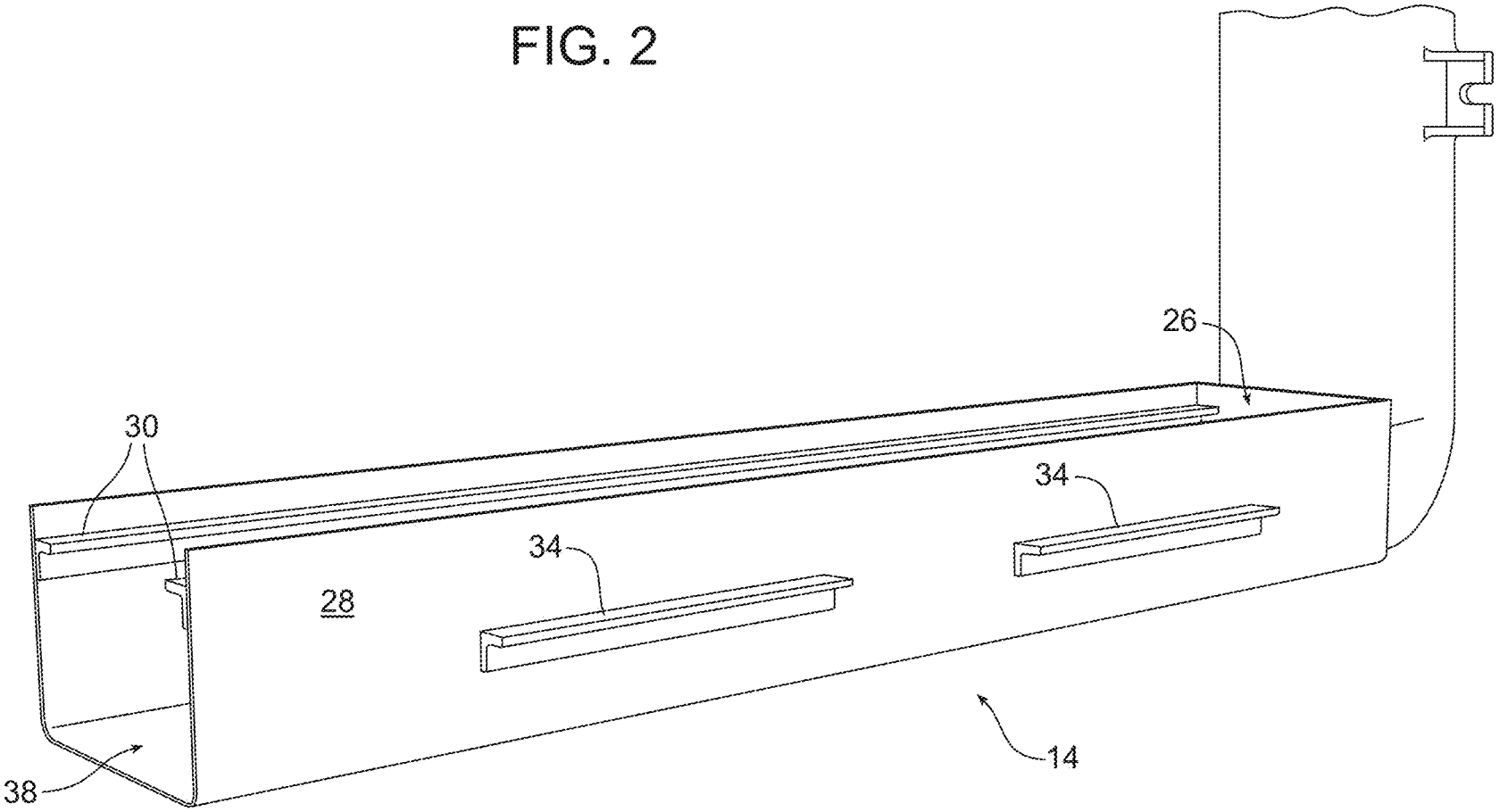
FIG. 2 shows a trench drain for use in the disclosed system.
Figure 3:
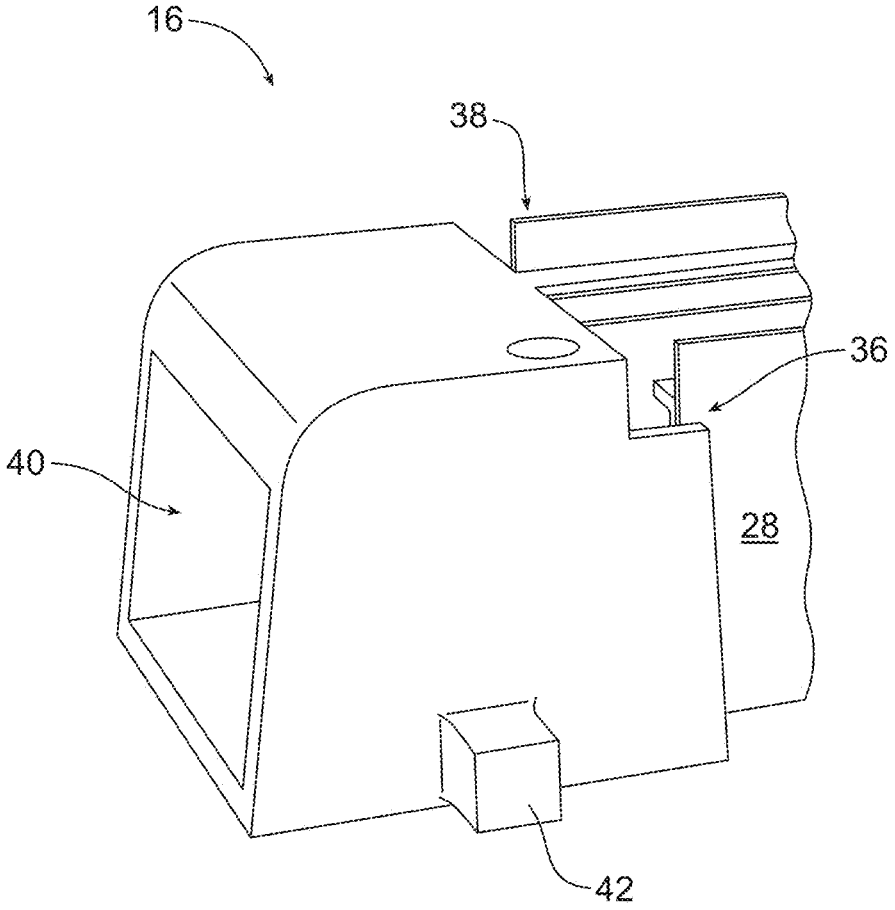
FIG. 3 shows a curb opening for use in the disclosed system.

To solve the above summarized and other problems, in the present disclosure is described in one embodiment a downspout boot-to-curb drain system 10 (see FIG. 5) including in embodiments a downspout boot 12 (see FIG. 1), a trench drain 14 (see FIG. 2) a grate assembly 18 (see FIG. 4), and a curb opening 16 (see FIG. 3).

Figure 5:
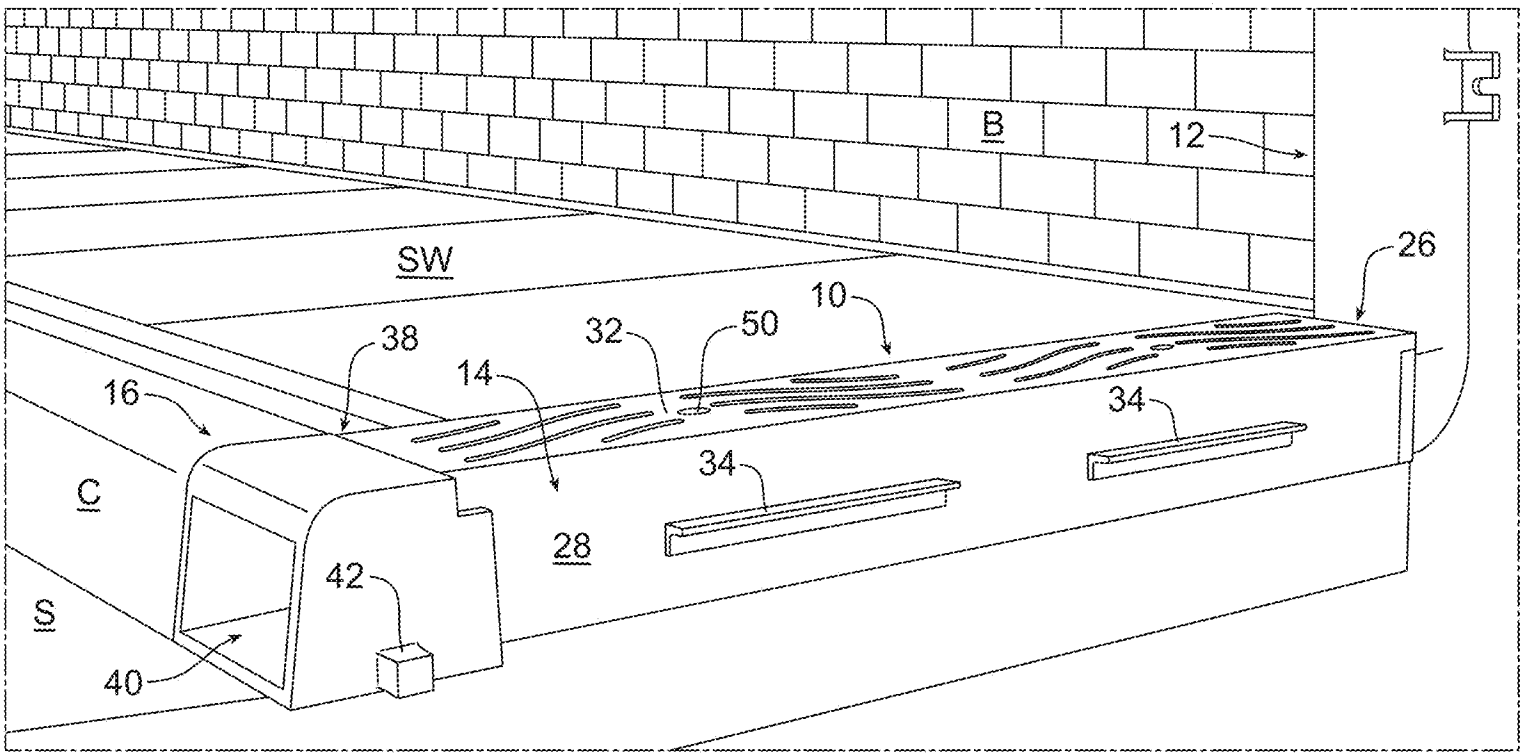
FIG. 5 shows a cutaway view of an embodiment of an assembled and installed downspout boot to curb drain system according to the present disclosure.

The downspout boot 12 may be fabricated to provide a smooth, contoured interior channel (not visible in this view) providing an efficient laminar hydraulic flow pattern of runoff water. With reference to FIGS. 1 and 5, the downspout boot 12 includes a top bell 20 configured for mating with and placing an interior of the downspout boot 12 in fluid communication with a downspout (not shown) which channels the flow of runoff water from a gutter system (not shown). The top bell 20 is configured to receive an end of the downspout, and is in fluid communication with a body 22. The body 22 may optionally include a cleanout (not shown) providing access to an interior of the downspout boot to allow removing or flushing any debris which may accumulate over time. The body 22 is in fluid communication with an outlet 24, configured for connection to trench drain 14 (see FIGS. 2 and 5) described below, which transports collected rainwater or run-off water, rainwater run-off, etc. collected from the downspout and downspout boot, etc. to curb opening 16 (see FIGS. 3 and 5). As will be appreciated, the outlet 24 is configured to provide a 90 degree diversion of fluid flow from the body 22 into a trench drain as will be described below.

In embodiments, the downspout boot 12 may be fabricated to remove interior obstacles which could potentially interfere with a laminar fluid flow and/or which could create areas of stagnant fluid, such as sharp transition angles, outlet choke points, interior lips or ledges, boxed corners, and other undesirable transition points interfering with a laminar fluid flow pattern.

With reference to FIGS. 2 and 5 a trench drain 14 is provided, configured to be placed in fluid communication at a first end 26 with the downspout boot outlet 24 (not visible in this view). In the depicted embodiment the trench drain 14 includes an elongated body 28 defining a trench pan having a substantially square cross-sectional dimension. It will be appreciated that alternative body cross-sectional configurations are possible and contemplated for the trench body 28, including without intending any limitation rectangular, cylindrical, semi-cylindrical, u-shaped, and others. Flanges 30 are provided in an interior of the body 28 which support a grate 32 (see FIG. 4). Anchors 34 for retaining the trench drain 14 in position are provided on an exterior of body 28, in the depicted embodiment being flanges although any known exterior anchor is contemplated. As will be appreciated, the anchors 34 embed in the substrate in which the trench drain is placed (such as dirt, cement, concrete, asphalt, gravel, etc.; see FIG. 5) and retain the trench drain 14 in position in that substrate.

With reference to FIGS. 3 and 5 a curb opening 16 is provided, having a first end 36 configured to be placed in fluid communication with a second end 38 of trench drain 18. Curb opening 16 further includes an outlet 40 positioned to discharge collected water onto an adjacent street surface S. Anchors 42 (only one visible in this view) are provided on an exterior of curb opening 16 to retain the curb opening in position in curb C or any other substrate in which the curb opening is positioned. Typically curb opening 16 will have a profile that matches at least a portion of a profile of curb C, for aesthetic and other reasons.

Figure 4:
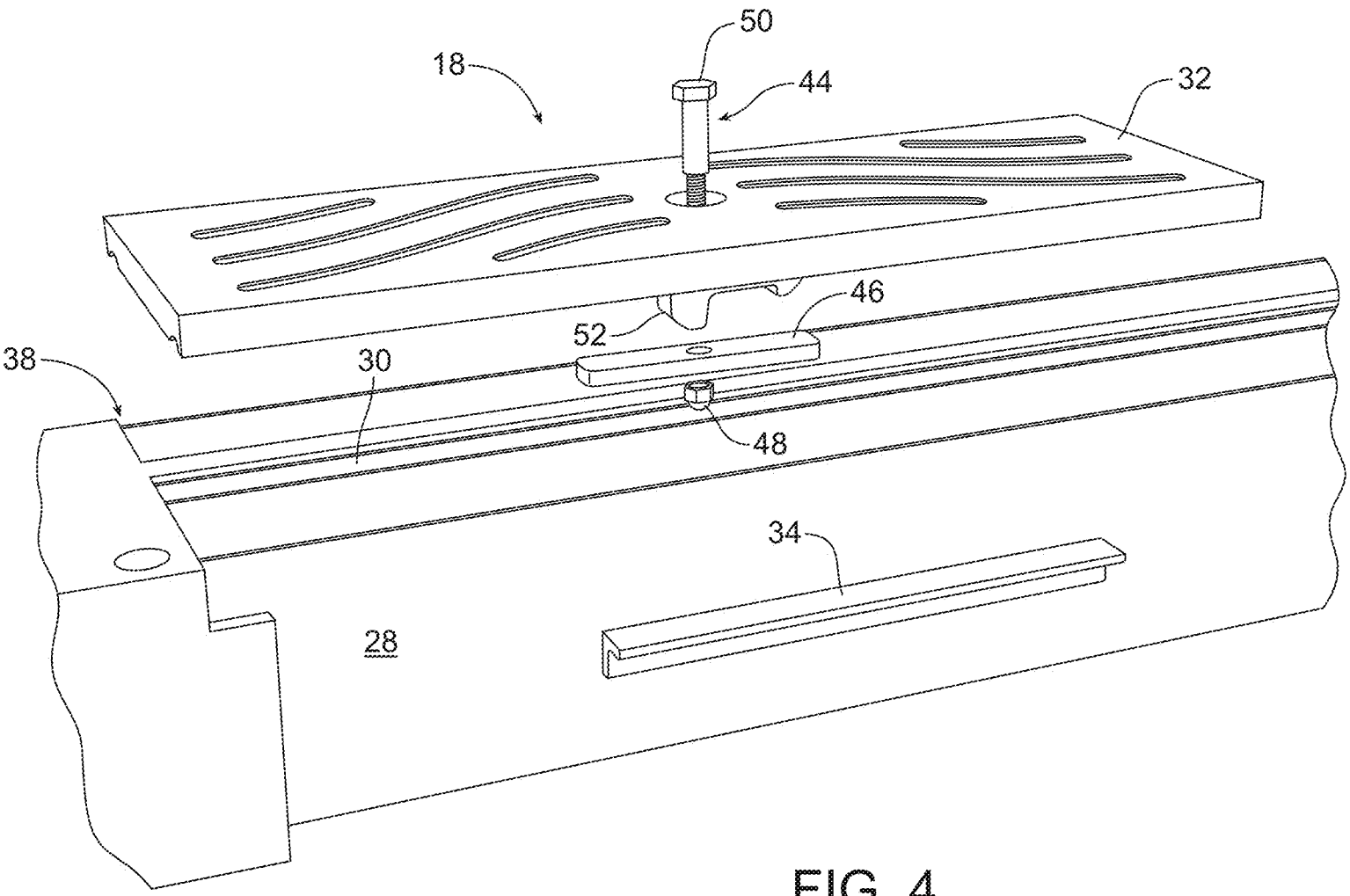
FIG. 4 shows a locking grate for use with the trench drain of FIG. 2.

With reference to FIG. 4, a grate 32 is provided for covering trench drain body 28 to inhibit accumulation of debris in body 28. Grate 32 is provided with a locking system, in the depicted embodiment being a swivel lock system comprising a bolt 44 passed through a through-bore in grate 32, a lock bar 46, and a nut 48. Bolt 44 may include a pentagonal head 50 which by virtue of its unconventional shape reduces the potential for theft due to the specialized tool required to engage and rotate the bolt. In use, bolt 44 is turned to cause lock bar 46 to rotate and to engage a lock bar stop 52 positioned on an underside of grate 32. If an attempt is made to remove grate 32, lock bar 46 will contact an underside of flanges 30 which serve as a grate stop to prevent such removal.

As shown in FIG. 5, the described embodiment of a downspout-to-curb drain system 10 finds a variety of uses including channeling roof runoff water from buildings, collection/drainage/channeling of rainwater from sidewalks, etc. As shown, downspout boot 12 is secured to a building B side, trench drain 18 is embedded in the sidewalk SW such that the top surface of grate 32 is substantially flush with the sidewalk SW top surface, and curb opening 16 is disposed substantially flush with an exterior profile of curb C. As shown in the figure, downspout boot 12 mates with the first end 26 of trench drain 18 below grade, i.e. below the top surface of the sidewalk/concrete slab in which the trench drain is placed. By the configuration of outlet 24, the flow of water from a downspout (not shown) is diverted approximately 90 degrees from vertical into and through trench drain 14 to exit from curb opening 16 onto street S, all also below grade. From there, water can drain to a storm sewer (not shown) or other structure for managing water runoff.

With reference to FIG. 6, a variety of embodiments of couplers and end plates may be provided for use with the described trench drain body 28. FIG. 6A shows an endplate 54 which may be provided if it is desired to simply seal an end of body 28. As shown in FIG. 6C, in one embodiment an end plate 56 is provided defining a narrowed inlet 58 having a rectangular or square cross-sectional dimension configured to mate securely with downspout boot outlet 24, which also defines a rectangular or square cross-sectional dimension. FIG. 6D shows a coupler 60 for use in connecting adjoining trench drain bodies 28. FIG. 6E shows an alternative end plate 62 for second end 38 of body 28, defining a flat surface for use in the event curb C defines a vertical curb profile rather than a tapered curb profile as shown in FIG. 5. As before, the flow of runoff water is kept below grade from downspout boot outlet 24 to curb opening outlet 40.

Figure 6A:
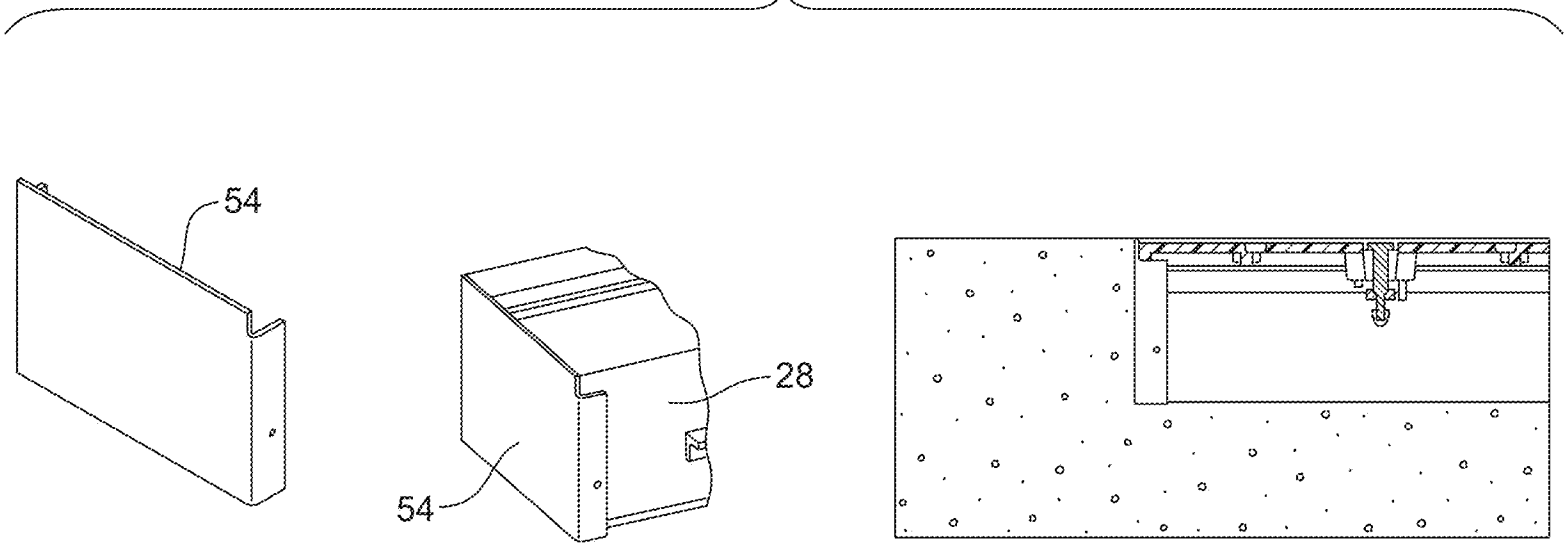
FIGS. 6A-E show embodiments of end plates and couplers for use with various embodiments or placements of the trench drain of FIG. 2.
Figure 6B:
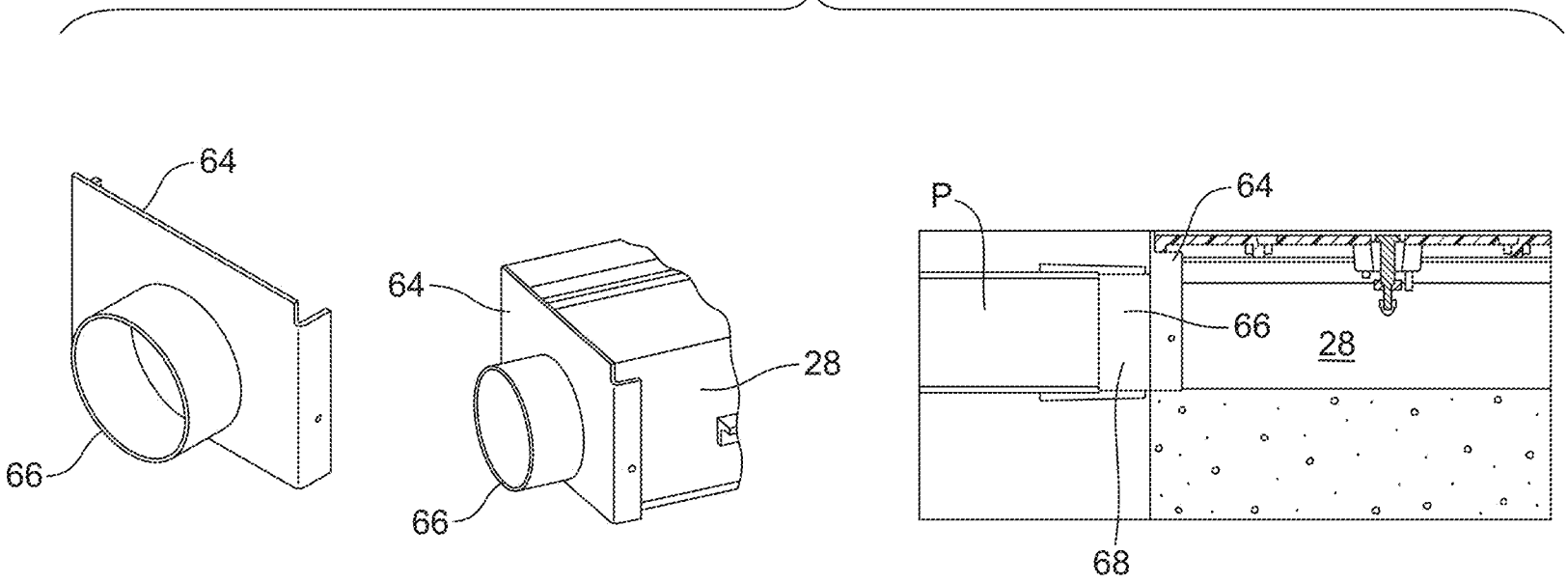
Figure 6C:
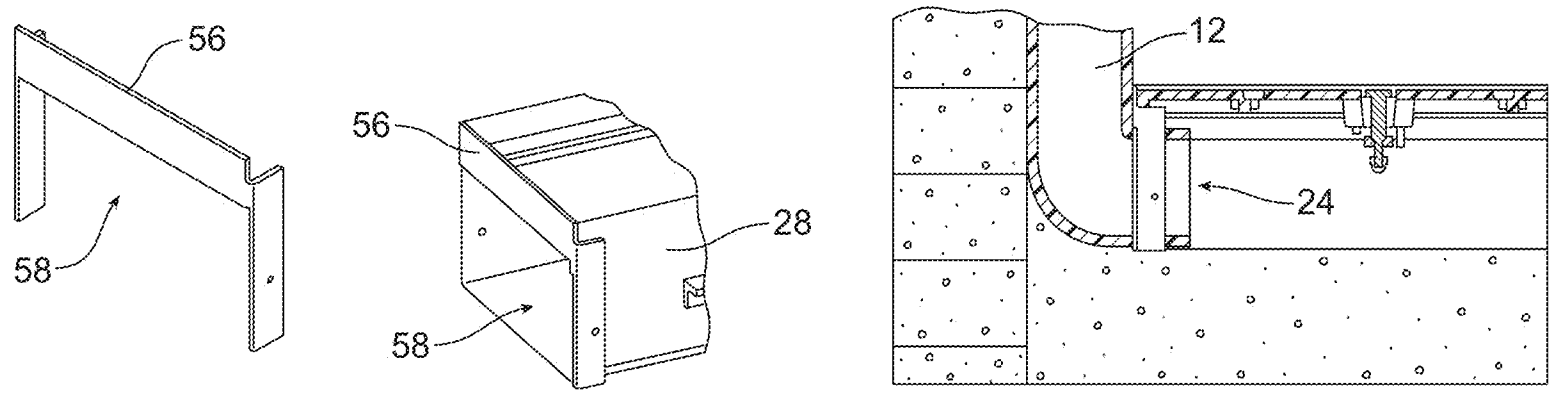
Figure 6D:
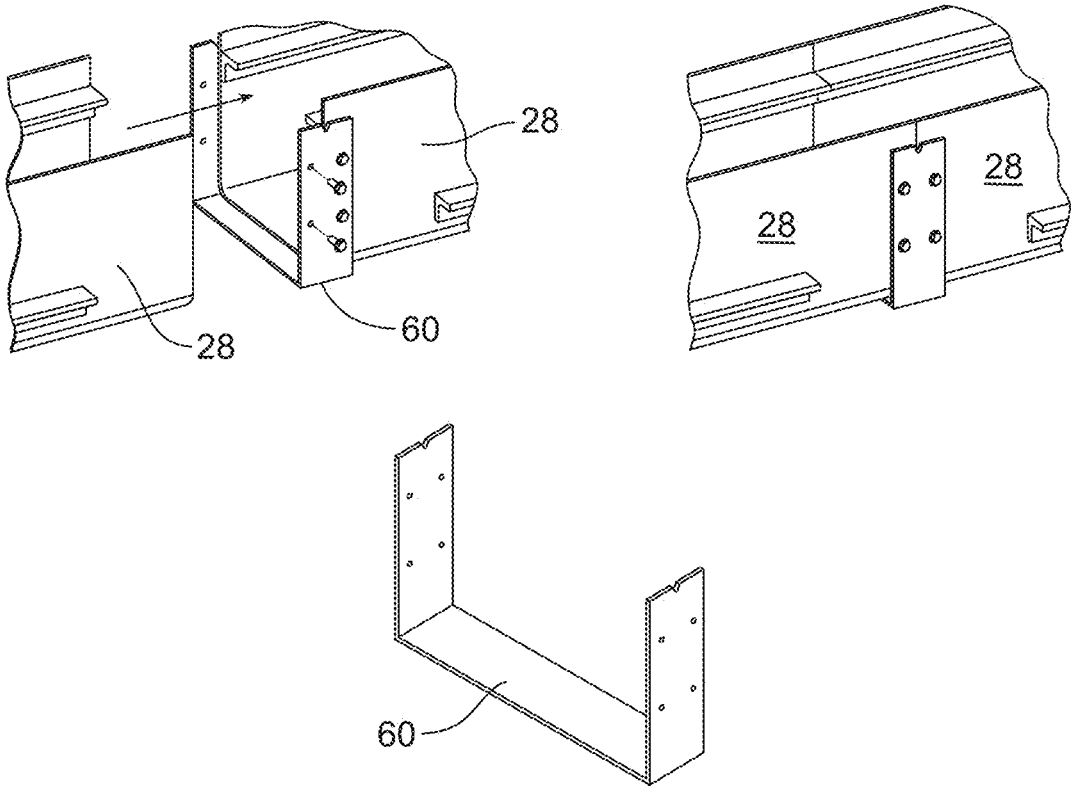
Figure 6E:
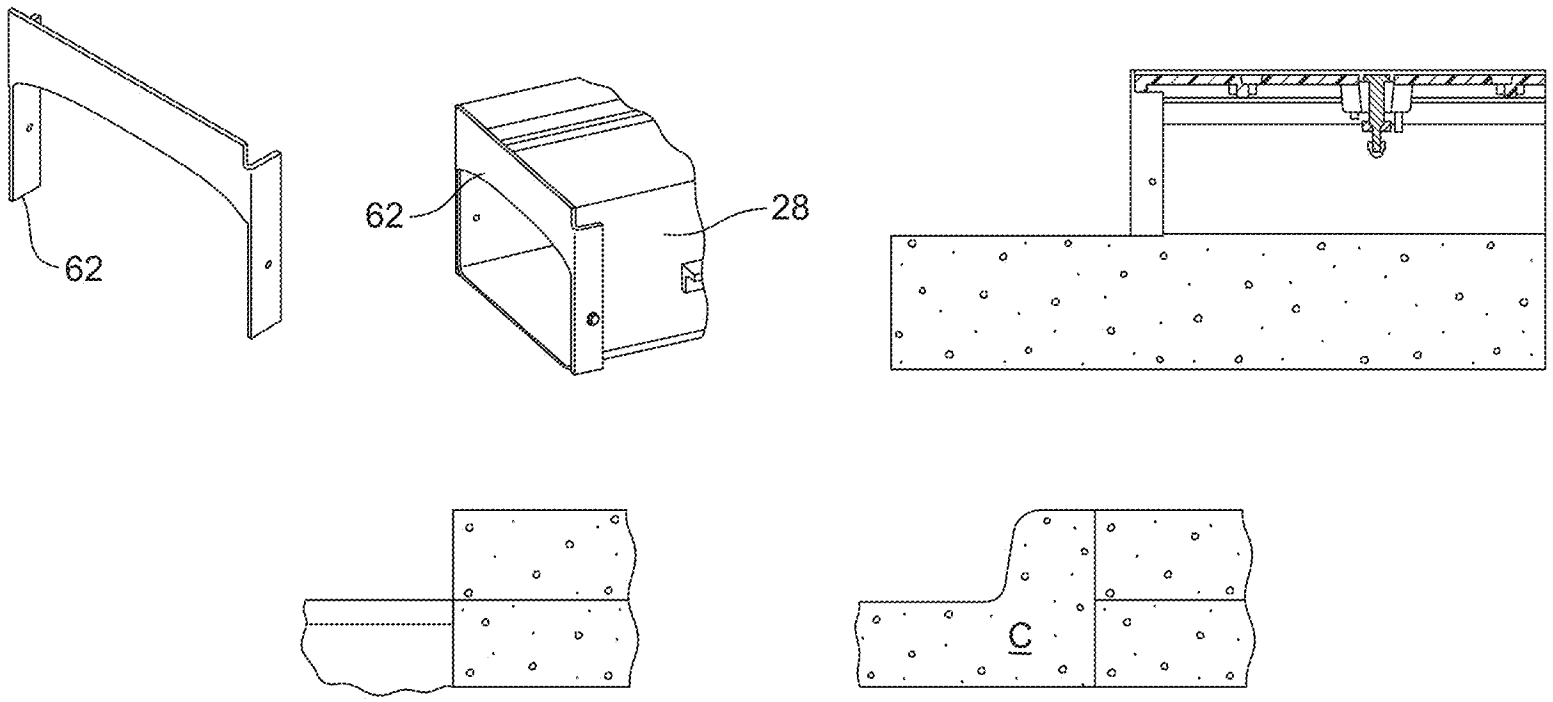
Figure 7:
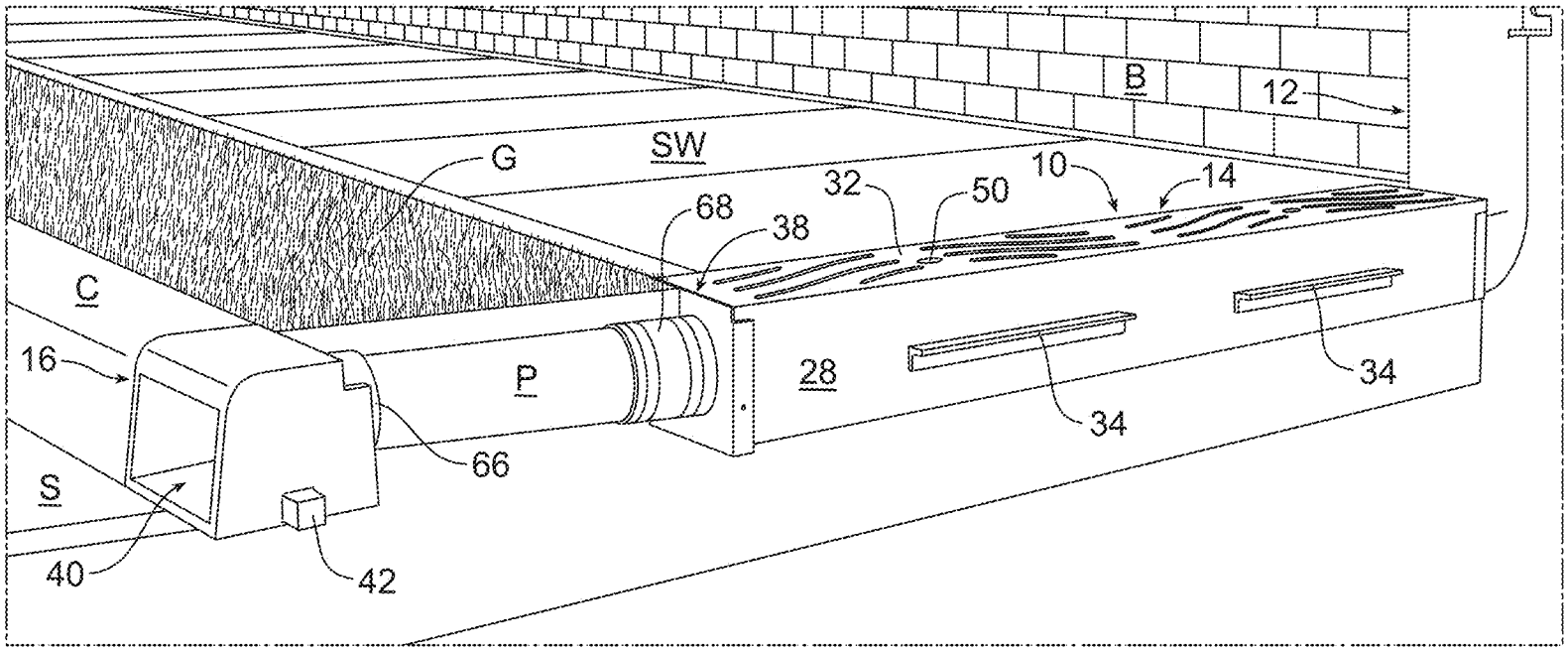
FIG. 7 shows a cutaway view of an alternative embodiment of a downspout boot to curb drain system according to the present disclosure.
Figure 8:
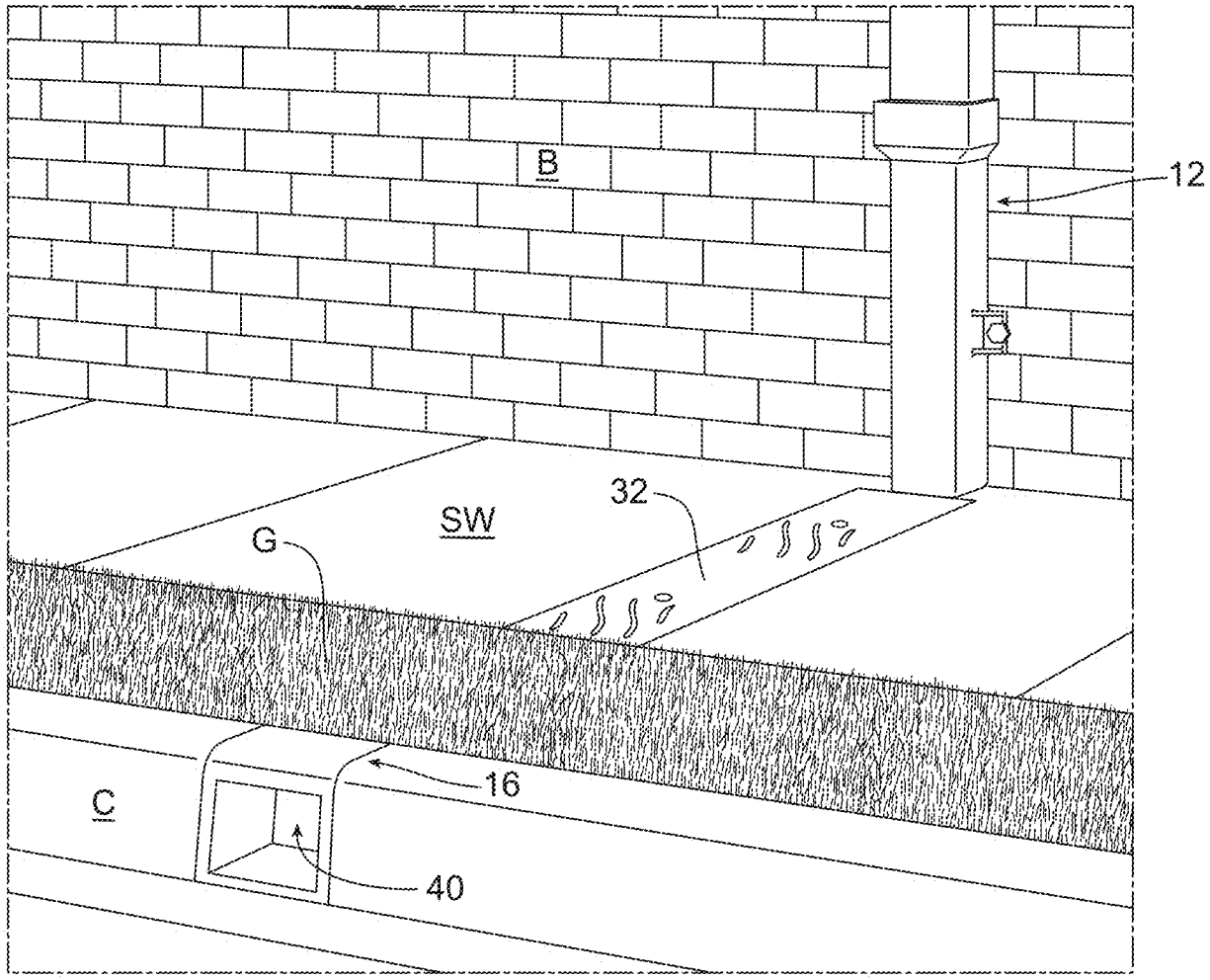
FIG. 8 shows the alternative embodiment of the downspout boot to curb drain system of FIG. 7, installed.

FIG. 6B illustrates an end plate 64 intended for use in the situation illustrated in FIGS. 7 and 8 when a section of greenspace is interposed between sidewalk SW and curb C. As depicted, end plate 64 includes a pipe coupler 66 configured to place second end 38 of body 28 in fluid communication with a pipe P, such as a PVC pipe. A rubber adaptor 68 may be used to mate pipe P to pipe coupler 66. As shown in FIGS. 7 and 8, a similar end plate (not visible in this view) and pipe coupler 66 may be used to place curb opening 16 in fluid communication with pipe P. In this manner runoff water may be diverted from a building and/or sidewalk SW beneath greenspace or other green infrastructure to a surface of street S, and from there to a storm sewer (not shown) or other disposal system. Again, the flow of runoff water is kept below grade from downspout boot outlet 24 to curb opening outlet 40.

The disclosed trench drain 14 and curb opening 16 also find utility in situations when it is desirable to divert at least a portion of runoff water to greenspace or other green infrastructure such as rain gardens, bioswales, urban landscaping, and others. Such green infrastructure is increasingly used for controlling stormwater, reducing flooding, improving water quality, etc. Reducing the amount of areas of impervious surfaces such as roadways, sidewalks, etc. through bioretention and infiltration in existing and new developments contributes to cleaner watersheds and a healthier, more sustainable construction environment.

Figure 9:
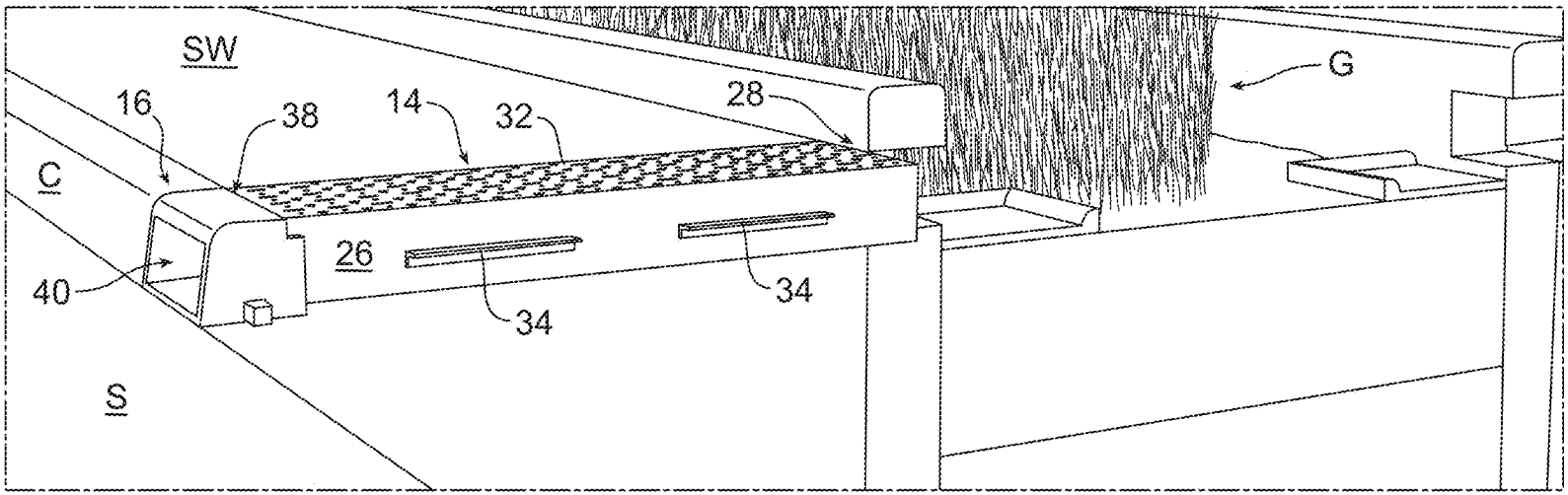
FIG. 9 shows a cutaway view of another alternative embodiment of a trench drain system according to the present disclosure.

As is shown in FIG. 9 the disclosed curb opening 16 and trench drain 14 may be positioned adjacent greenspace areas, in the depicted embodiment being greenspace G in a roadway median, such that runoff water from sidewalk SW is at least partially diverted to greenspace G and the plants growing therein. This reduces the need for all runoff water flow to be directed through traditional stormwater sewer systems, and allows implementation of increased areas of greenspace adjacent to roadways and buildings.

Figure 10A:
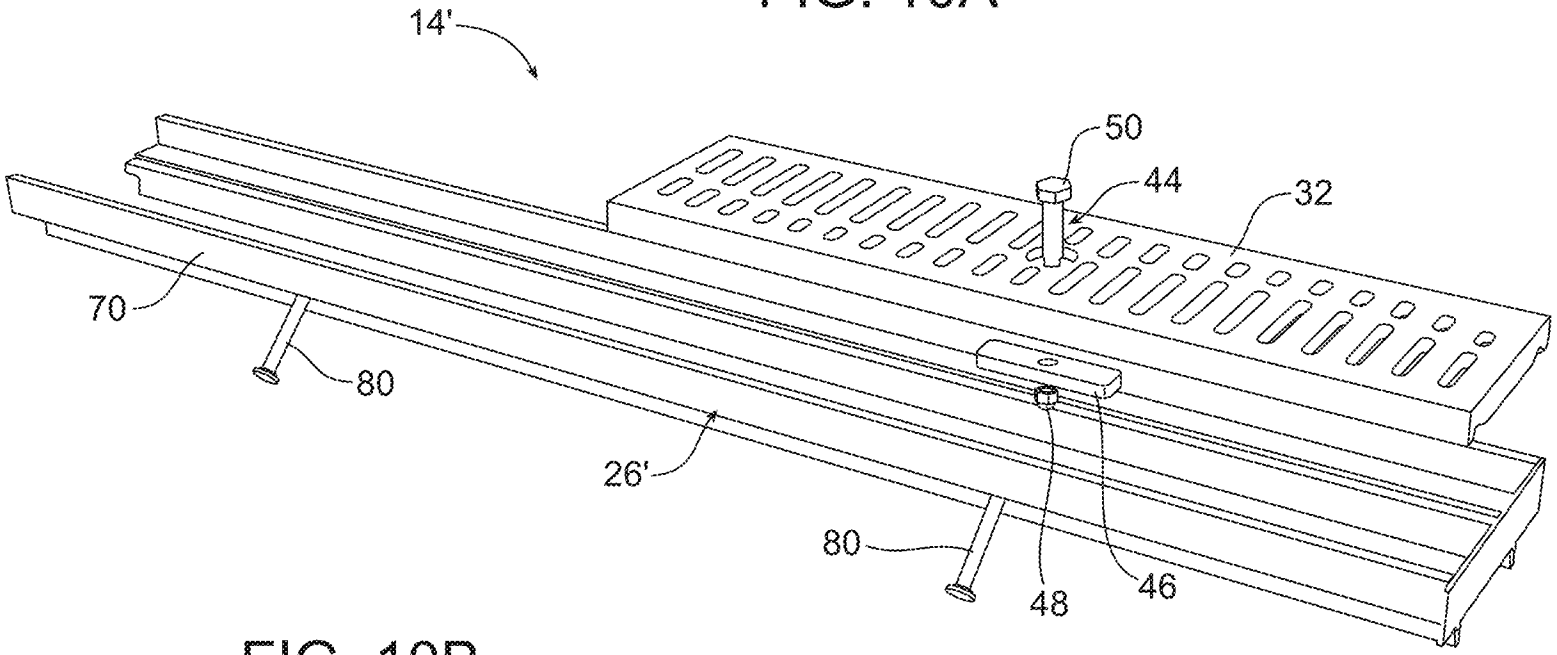
FIGS. 10A-B respectively show a perspective view and an end view of yet another alternative embodiment of a trench drain including a locking grate according to the present disclosure.
Figure 10B:
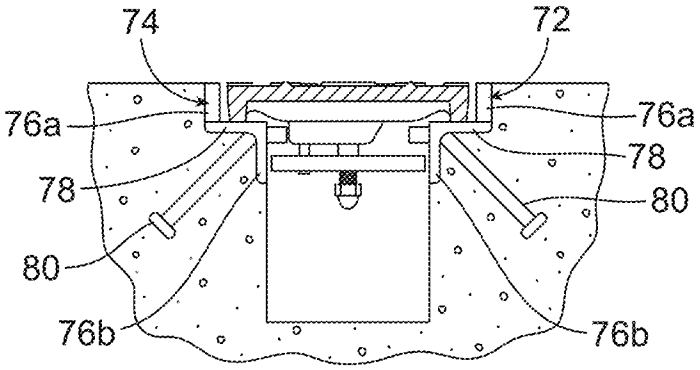
Figure 11A:
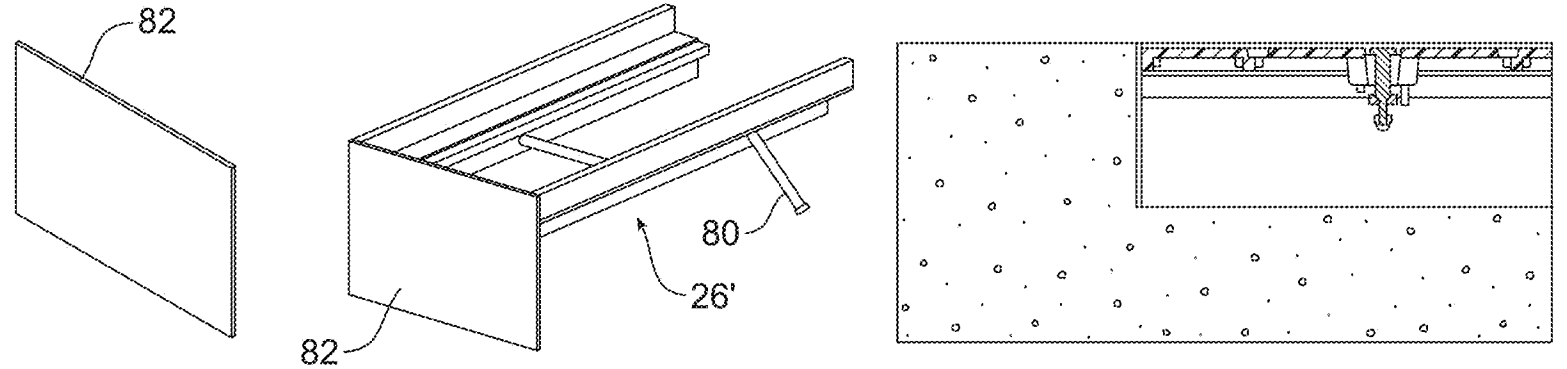
FIGS. 11A-D show embodiments of end plates for use with the trench drain of FIG. 10.
Figure 11B:
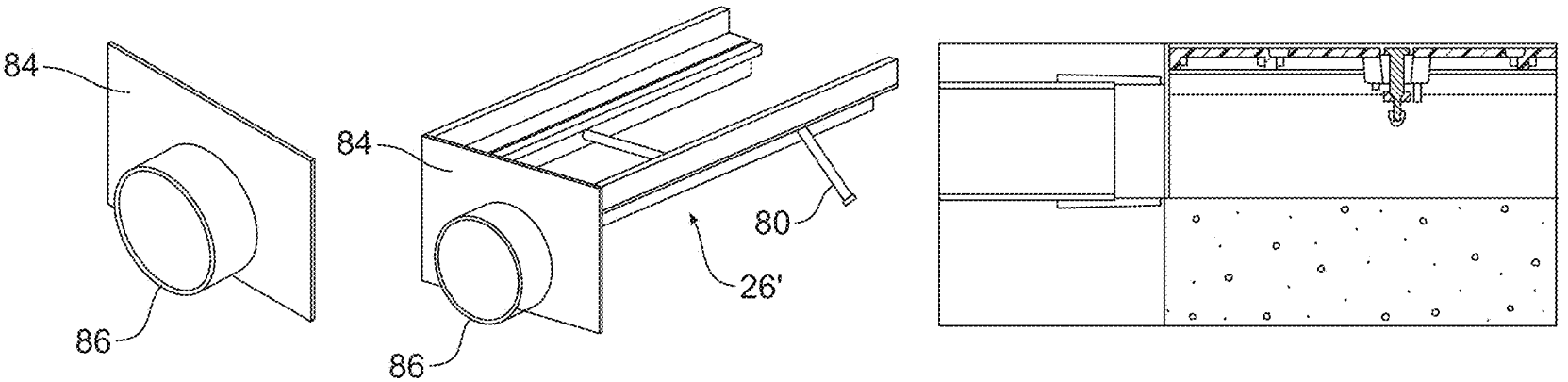
Figure 11C:
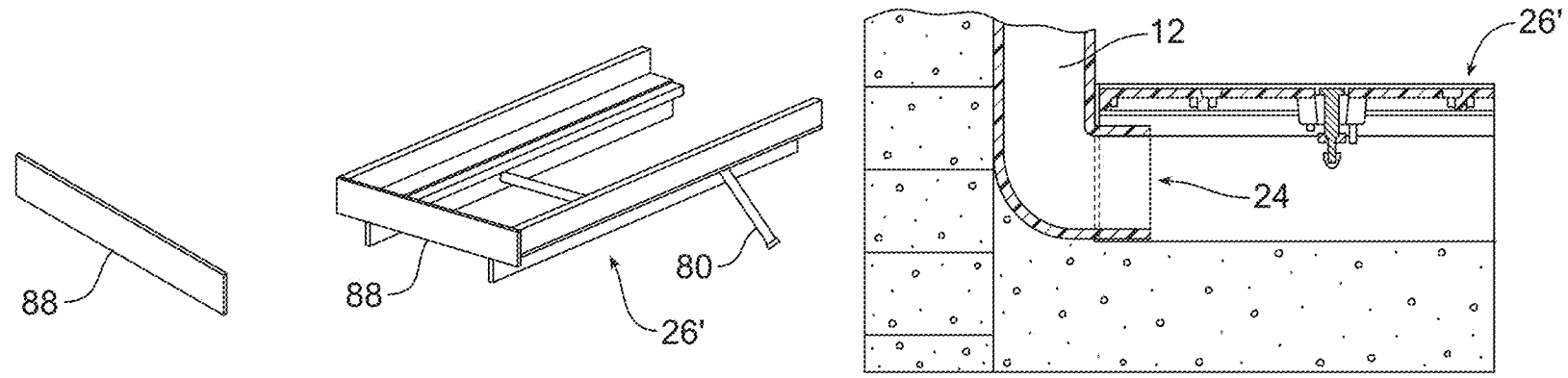
Figure 11D:
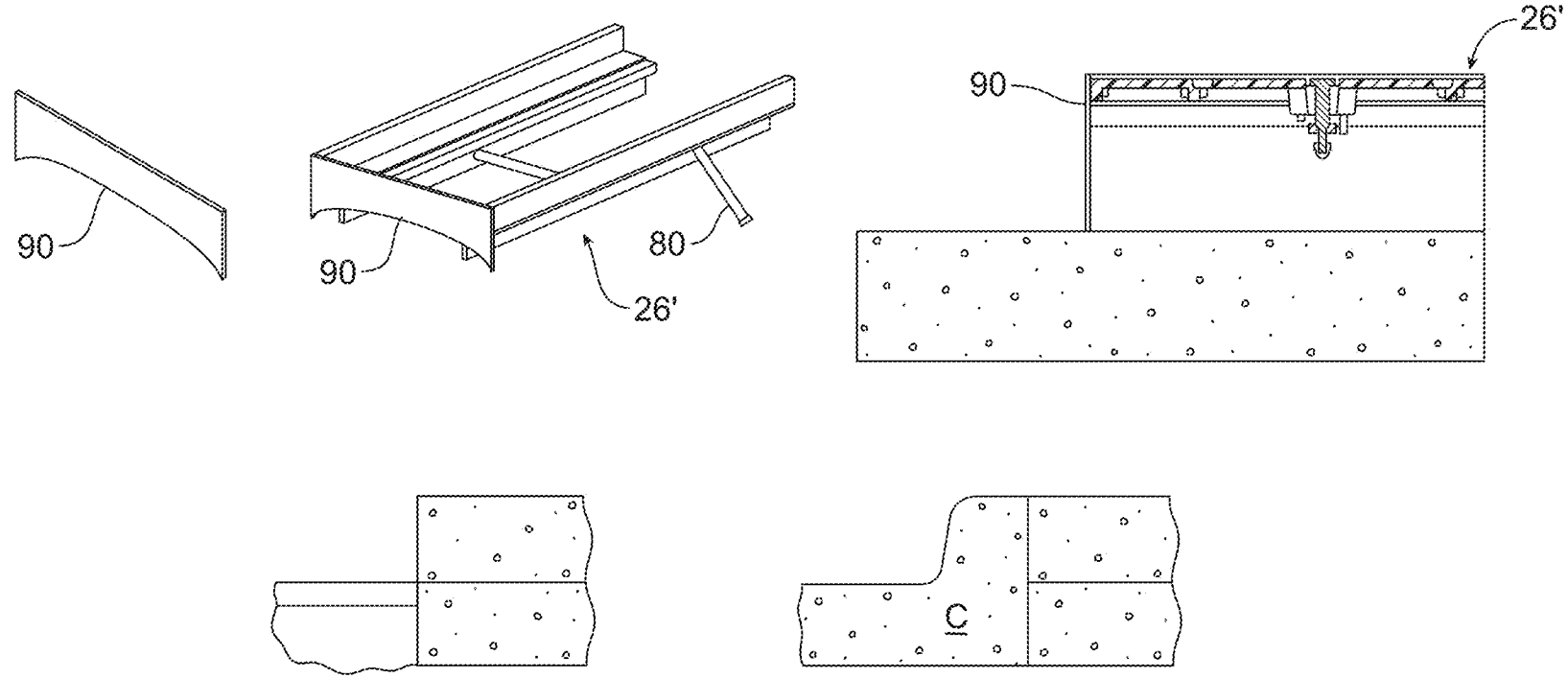

In another aspect of the disclosure, with reference to FIG. 10 an alternative trench drain 14' is shown, including a grate 32 and locking system substantially as described above. The trench drain body 26' is defined by an open-bottomed frame 70 having left and right walls 72, 74 each defined by two upright portions 76*a*, 76*b* connected by a connecting portion 78. The substantially horizontal portion 78 defines an interior lip or ledge on which grate 32 rests. In the depicted embodiment, flanges 30' are provided to serve as a grate stop as described above, although it is possible and contemplated to provide that function by extending connecting portions 78 beyond an imaginary line defined by upright portions 76*b*. A plurality of anchors 80, in the depicted embodiment being Nelson studs, extend from frame 70. As will be appreciated, the plurality of anchors 80 embed in the substrate in which the frame 70 is placed so and retain the trench drain 14' in position in that substrate.

With reference to FIG. 11, a variety of embodiments of end plates may be provided for use with the described trench drain body 26'. FIG. 11A shows an endplate 82 which may be provided if it is desired to simply seal an end of body 26'. FIG. 11B shows an endplate 84 including a pipe coupler 86 provided configured to place body 26' in fluid communication with a pipe (not shown), such as a PVC pipe, to allow below-ground transport of runoff water from or to body 26'. FIG. 11C shows an end plate 88 configured to mate body 26' with an outlet 24 of downspout boot 12. FIG. 11D shows an end plate defining a flat surface for use in the event curb C defines a vertical curb profile rather than a tapered curb profile.

Figure 12:
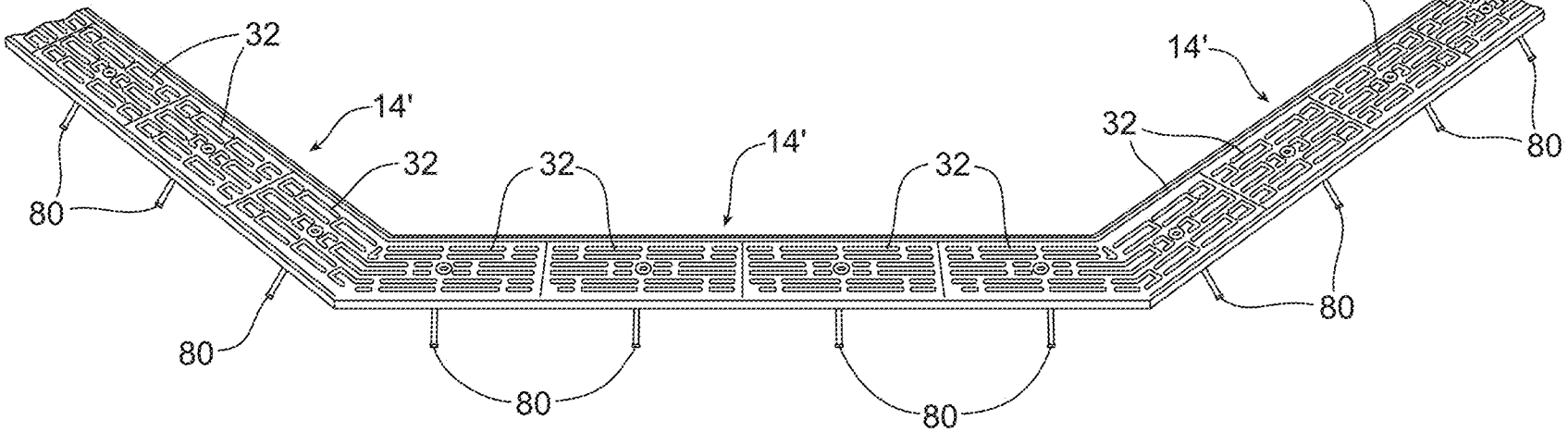
FIG. 12 shows an arrangement of trench drains of FIG. 11 disposed at angles relative to one another for use in streetscape design.

As shown in FIG. 12, trench drains 14, 14' may be provided with varying end mating surfaces allowing a desired included angle to be defined between adjoining trench drain bodies 26, 26'. As non-limiting examples, included angles of 45 degrees, 90 degrees or other as required may be defined. The described trench drains 14, 14' may be positioned to collect runoff water near, and/or divert collected runoff to, streetscaping features.

From the foregoing, it will be seen that the disclosed subject matter is well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting. Although any methods, devices, and materials similar or equivalent to those described herein can be used in the practice or testing of the presently-disclosed subject matter, representative methods, devices, and materials are described herein.

Many changes, modifications, variations and other uses and applications of the present construction will become apparent to those skilled in the art after considering the specification and the accompanying drawings. All such changes, modifications, variations and other uses and applications which do not depart from the spirit and scope of the invention are deemed to be covered by the invention which is limited only by the claims which follow. The foregoing description is for the purpose of illustration only, and not for the purpose of limitation.

What is claimed:

1. A downspout-to-curb drain assembly, comprising:

a downspout boot defining an interior channel terminating in a downspout boot outlet;

a trench drain assembly in fluid communication at a first end thereof with the downspout boot interior channel and outlet; and a curb opening defining an interior channel in fluid communication with the trench drain assembly at a second end thereof;

wherein the downspout boot outlet, trench drain assembly, and curb opening transport water runoff below grade to discharge water onto an above grade surface.

2. The downspout-to-curb drain assembly of claim 1, wherein the trench drain assembly comprises:

a grate including at least one grate locking assembly; and an elongated body comprising at least two interior supports for the grate.

3. The downspout-to-curb drain assembly of claim 2, wherein the grate includes at least one through-bore and at least one through-bore-adjacent lock bar stop disposed on a bottom surface of the grate.

4. The downspout-to-curb drain assembly of claim 3, wherein the at least one grate locking assembly comprises a bolt passed through the through-bore and a lock bar carried at an end of the bolt.

5. The downspout-to-curb drain assembly of claim 4, wherein the bolt is dimensioned to carry the lock bar at a spaced distance below the bottom surface of the grate whereby turning the bolt causes the lock bar to engage the stop;

further wherein the lock bar is dimensioned such that an attempt to remove the grate will cause the lock bar to contact one of a grate stop disposed on an interior of the elongated body or a bottom surface of the at least two interior supports.

6. The downspout-to-curb drain assembly of claim 2, wherein the elongated body further comprises at least one exterior anchor configured to anchor the elongated body in a substrate.

7. The downspout-to-curb drain assembly of claim 2, wherein the elongated body is a trench pan defining a channel having a substantially rectangular or square cross-sectional dimension.

8. The downspout-to-curb drain assembly of claim 2, wherein the elongated body is a frame defined by adjacent walls, wherein each adjacent wall is defined by a pair of upright portions and a connecting portion.

9. The downspout-to-curb drain assembly of claim 8, wherein the connecting portions define the at least two interior supports for the grate.

10. A downspout-to-curb drain assembly, comprising:

a downspout boot defining an interior channel terminating in a downspout boot outlet;

a trench drain assembly in fluid communication at a first end thereof with the downspout boot interior channel and outlet; and a curb opening defining an interior channel and in fluid communication with the trench drain assembly at a second end thereof;

wherein the trench drain assembly comprises:

a grate including at least one grate locking assembly; and an elongated body comprising at least two interior supports for the grate, the elongated body being a trench pan defining a channel having a substantially rectangular or square cross-sectional dimension;

further wherein the downspout boot outlet, trench drain assembly, and curb opening transport water runoff below grade.

11. The downspout-to-curb drain assembly of claim 10, wherein the grate includes at least one through-bore and at least one through-bore-adjacent lock bar stop disposed on a bottom surface of the grate.

12. The downspout-to-curb drain assembly of claim 11, wherein the at least one grate locking assembly comprises a bolt passed through the through-bore and a lock bar carried at an end of the bolt.

13. The downspout-to-curb drain assembly of claim 12, wherein the bolt is dimensioned to carry the lock bar at a spaced distance below the bottom surface of the grate whereby turning the bolt causes the lock bar to engage the stop;

further wherein the lock bar is dimensioned such that an attempt to remove the grate will cause the lock bar to contact one of a grate stop disposed on an interior of the elongated body or a bottom surface of the at least two interior supports.

14. The downspout-to-curb drain assembly of claim 10, wherein the elongated body further comprises at least one exterior anchor configured to anchor the elongated body in a substrate.

15. A downspout-to-curb drain assembly, comprising:

a downspout boot defining an interior channel terminating in a downspout boot outlet;

a trench drain assembly in fluid communication at a first end thereof with the downspout boot interior channel and outlet; and a curb opening defining an interior channel and in fluid communication with the trench drain assembly at a second end thereof;

wherein the trench drain assembly comprises:

a grate including at least one grate locking assembly; and an elongated body comprising at least two interior supports for the grate, the elongated body being a frame defined by adjacent walls, wherein each adjacent wall is defined by a pair of upright portions and a connecting portion;

further wherein the downspout boot outlet, trench drain assembly, and curb opening transport water runoff below grade.

16. The downspout-to-curb drain assembly of claim 15, wherein the grate includes at least one through-bore and at least one through-bore-adjacent lock bar stop disposed on a bottom surface of the grate.

17. The downspout-to-curb drain assembly of claim 16, wherein the at least one grate locking assembly comprises a bolt passed through the through-bore and a lock bar carried at an end of the bolt.

18. The downspout-to-curb drain assembly of claim 17, wherein the bolt is dimensioned to carry the lock bar at a spaced distance below the bottom surface of the grate whereby turning the bolt causes the lock bar to engage the stop;

further wherein the lock bar is dimensioned such that an attempt to remove the grate will cause the lock bar to contact one of a grate stop disposed on an interior of the elongated body or a bottom surface of the at least two interior supports.

19. The downspout-to-curb drain assembly of claim 15, wherein the elongated body further comprises at least one exterior anchor configured to anchor the elongated body in a substrate.

20. The downspout-to-curb drain assembly of claim 15, wherein the connecting portions define the at least two interior supports for the grate.

21. A downspout-to-curb drain assembly, comprising:

a downspout boot defining an interior channel terminating in a downspout boot outlet;

a trench drain assembly in fluid communication at a first end thereof with the downspout boot interior channel and outlet; and a curb opening defining an interior channel in fluid communication with the trench drain assembly at a second end thereof;

wherein the trench drain assembly comprises:

a grate;

an elongated body having a substantially rectangular or square cross-sectional dimension and defined by a frame having adjacent walls each defined by a pair of upright portions and a connecting portion, the connecting portion of each of the adjacent walls defining a pair of interior supports for the grate; and further wherein the downspout boot outlet, trench drain assembly, and curb opening transport water runoff below grade to discharge water onto an exterior above grade surface.

22. The downspout-to-curb drain assembly of claim 21, further including at least one grate locking assembly comprising a bolt passed through a grate through-bore and a lock bar carried at an end of the bolt.

23. The downspout-to-curb drain assembly of claim 22, wherein the bolt is dimensioned to carry the lock bar at a spaced distance below the bottom surface of the grate whereby turning the bolt causes the lock bar to engage the stop;

further wherein the lock bar is dimensioned such that an attempt to remove the grate will cause the lock bar to contact one of a grate stop disposed on an interior of the elongated body or a bottom surface of the pair of interior supports.

* * * * *